US008739862B2

(12) United States Patent
Niina et al.

(10) Patent No.: US 8,739,862 B2
(45) Date of Patent: Jun. 3, 2014

(54) SYSTEM FOR CONTROLLING FLOW OF AN ACTUATING FLUID

(75) Inventors: Nobuyoshi Niina, Cheltenham (GB); Oleg Polyntsev, Cheltenham (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 784 days.

(21) Appl. No.: 12/887,217

(22) Filed: Sep. 21, 2010

(65) Prior Publication Data

US 2012/0067592 A1 Mar. 22, 2012

(51) Int. Cl.

| | |
|---|---|
| ***E21B 34/06*** | (2006.01) |
| ***E21B 7/04*** | (2006.01) |
| ***F16K 31/06*** | (2006.01) |

(52) U.S. Cl.
USPC ... 166/66.6; 175/61; 137/625.65; 137/596.17

(58) Field of Classification Search
USPC ..... 166/66.6, 66.7, 332.6; 175/61; 137/625.65, 596.17
See application file for complete search history.

(56) References Cited

U.S. PATENT DOCUMENTS

| | | | | |
|---|---|---|---|---|
| 6,028,499 | A | 2/2000 | Oudet et al. | |
| 7,464,761 | B2 * | 12/2008 | Hosatte et al. | 166/313 |
| 2008/0142269 | A1 | 6/2008 | Richards et al. | |
| 2009/0020293 | A1 | 1/2009 | Richards | |
| 2010/0126774 | A1 * | 5/2010 | Downton | 175/61 |

FOREIGN PATENT DOCUMENTS

| | | |
|---|---|---|
| EP | 0713604 | 3/1997 |
| JP | 7257341 | 10/1995 |

* cited by examiner

*Primary Examiner* — Shane Bomar
*Assistant Examiner* — Robert E Fuller
(74) *Attorney, Agent, or Firm* — Chadwick A. Sullivan; Brigitte Echols

(57) ABSTRACT

A valve system structure to facilitate actuation of tools, such as actuating pads in a steering section of a wellbore drilling assembly. A valve system may comprise a bi-stable actuator which controls two double-stage valves. Each of the double-stage valves is able to perform both charging and dumping functions which facilitate use of the valve system in a variety of downhole applications. In drilling applications, a single valve system is able to operate a plurality of actuating pads.

10 Claims, 4 Drawing Sheets

SYSTEM FOR CONTROLLING FLOW OF AN ACTUATING FLUID

BACKGROUND

A variety of valves are used to control flow of actuating fluids in many well applications and other flow control applications. For example, valves are employed in wellbore drilling applications to control the actuation of tools located in the wellbore being drilled. During wellbore drilling operations, valves positioned in a drilling assembly can be selectively actuated to control the direction of drilling. The valves may be positioned, for example, to control the flow of drilling mud to actuating pads which are extended and contracted in a controlled manner to steer the drill bit and thereby drill the wellbore in a desired direction.

In some drilling applications, bi-stable valves may be used to control the flow of drilling mud in both charging the actuating pads and in relieving backflow pressure. However, many types of bi-stable valves provide limited steering capacity because they exhibit no or limited dumping functionality, thus limiting backflow from the actuating pad discharge lines at high drilling RPMs. Some bi-stable valves systems are designed to perform both actuation of the actuating pads and discharge/dumping of the fluid and pressure following actuation. However, these types of bi-stable valves systems can suffer from excessive internal pressure differentials. Additionally, single-stage, bi-stable valve systems often require substantial increases in power to operate such systems under higher pressures. Existing systems also can suffer from decreasing efficiency at high drilling RPMs.

SUMMARY

In general, a system and methodology is provided to overcome many or all the problems associated with existing valve systems. According to one embodiment, a valve system comprises a bi-stable actuator which controls two double-stage valves. Each of the double-stage valves is able to perform both charging and dumping functions in a manner which enables use of the valve system in a variety of downhole applications, such as use in steering systems of downhole drilling assemblies. In drilling applications, a single valve system is able to operate a plurality of actuating pads.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
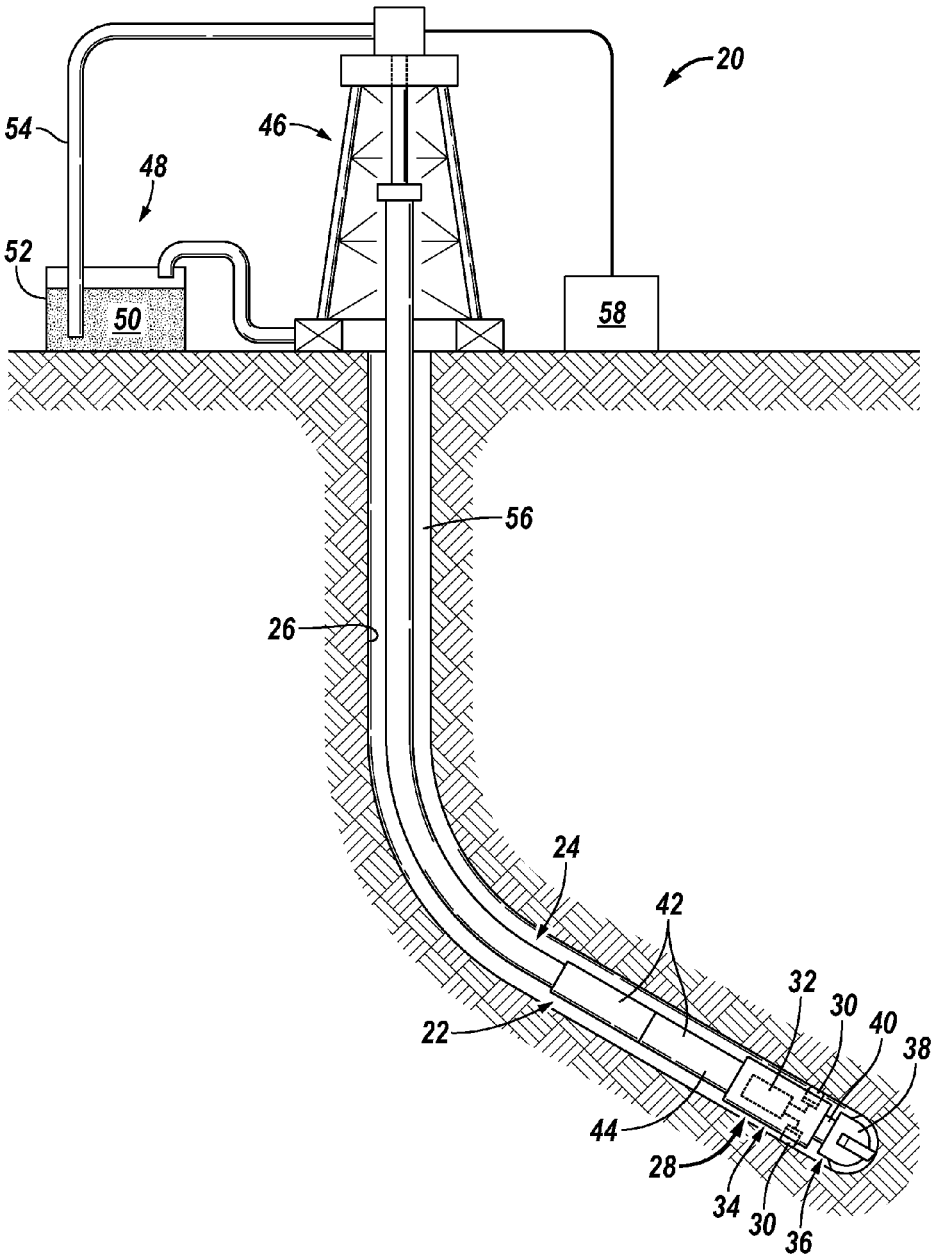
FIG. 1 is a schematic illustration of an example of a drill string which includes a steerable drilling assembly controlled by a valve system, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The embodiments described herein generally relate to a system and method for an improved valve system and improved tool control in a variety of applications. As described below, the system and method address the shortcomings of existing systems and provide better capabilities for use in many applications, such as downhole applications in which repeated actuation of a downhole tool is required. For example, the valve system may be employed in a steering section of a downhole drilling assembly to control operation of actuating pads which act against either a pivotable drilling assembly component or the surrounding wellbore wall to control the direction of drilling.

According to one embodiment, a valve system is provided with a bi-stable actuator which controls two double-stage valves. Each of the double-stage valves is able to perform both charging and dumping functions with respect to the flow of actuating fluid. This capability enables use of the valve system in wellbore drilling operations to improve control of steering systems in downhole drilling assemblies. For example, certain steering systems can use the bi-stable actuator to control two double-stage valves which, in turn, control the operation of a plurality of actuating pads, e.g. two actuating pads, in the downhole drilling assembly. The valve system, however, may be adapted to a variety of other downhole applications and surface applications where the use of a bi-stable actuator to control two double-stage valve sections is beneficial for improved control over fluid flow. As described in greater detail below, the valve system also may be designed with low power requirements by balancing the hydraulic holding forces acting on the bi-stable actuator.

In wellbore drilling applications, the design of the valve system may vary depending both on the environment in which the wellbores are formed and on the desired characteristics of the steerable drilling assembly. For example, the size and configuration of the actuator, e.g. a bi-stable actuator, may depend on the size and fluid flow requirements of the valve sections. Additionally, the location of the valve sections relative to the actuator may vary, as discussed in embodiments described below. The valve system also may be used in several types of drilling assemblies and can be employed to control actuating pads in several types of drilling assembly designs. For example, the actuating pads may be positioned to move against a corresponding pivotable component of the drilling assembly or against the surrounding wellbore wall to provide directional control in, for example, point-the-bit and push-the-bit drilling assemblies.

Referring generally to FIG. 1, an embodiment of a drilling system 20 is illustrated as having a bottom hole assembly 22 which is part of a drill string 24 used to form a desired, directionally drilled wellbore 26. The illustrated drilling system 20 comprises a downhole tool 28, e.g. a steerable drilling assembly, comprising a plurality of actuating members 30 controlled by a valve system 32. If the downhole tool is in the form of a steerable drilling assembly, the actuating members 30 may comprise actuating pads designed to act against a corresponding pivotable component of the drilling assembly 28 or against the surrounding wellbore wall to provide directional control. In this particular example, the valve system 32 may be positioned within a steering section 34 of the drilling assembly 28. As with conventional systems, the steering section 34 may be connected with a bit body section 36 having a drill bit 38 rotated by a drill bit shaft 40.

Depending on the environment and the operational parameters of the drilling operation, drilling system 20 may comprise a variety of other features. For example, drill string 24 may include drill collars 42 which, in turn, may be designed to incorporate desired drilling modules, e.g. logging-while-drilling and/or measurement-while-drilling modules 44. In some applications, stabilizers may be used along the drill string to stabilize the drill string with respect to the surrounding wellbore wall.

Various surface systems also may form a part of the drilling system 20. In the example illustrated, a drilling rig 46 is positioned above the wellbore 26 and a drilling fluid system 48, e.g. drilling mud system, is used in cooperation with the drilling rig 46. For example, the drilling fluid system 48 may be positioned to deliver a drilling fluid 50 from a drilling fluid tank 52. The drilling fluid 50 is pumped through appropriate tubing 54 and delivered down through drilling rig 46 and into drill string 24. In many applications, the return flow of drilling fluid flows back up to the surface through an annulus 56 between the drill string 24 and the surrounding wellbore wall. The return flow may be used to remove drill cuttings resulting from operation of drill bit 38. The drilling fluid 50 also may be used to control operation of the downhole tool, e.g. actuating members/pads 30. In this latter embodiment, valve system 32 is well-suited for employment in precisely controlling the metering of drilling fluid to actuating members 30 to achieve the desired directional control.

The drilling system 20 also may comprise many other components, such as a surface control system 58. The surface control system 58 may be used to communicate with steerable drilling assembly 28. In some embodiments, the surface control system 54 receives data from downhole sensor systems and also communicates commands to the steerable drilling assembly 28 to control actuation of valve system 32 and thus the direction of drilling during formation of wellbore 26.

Figure 2:
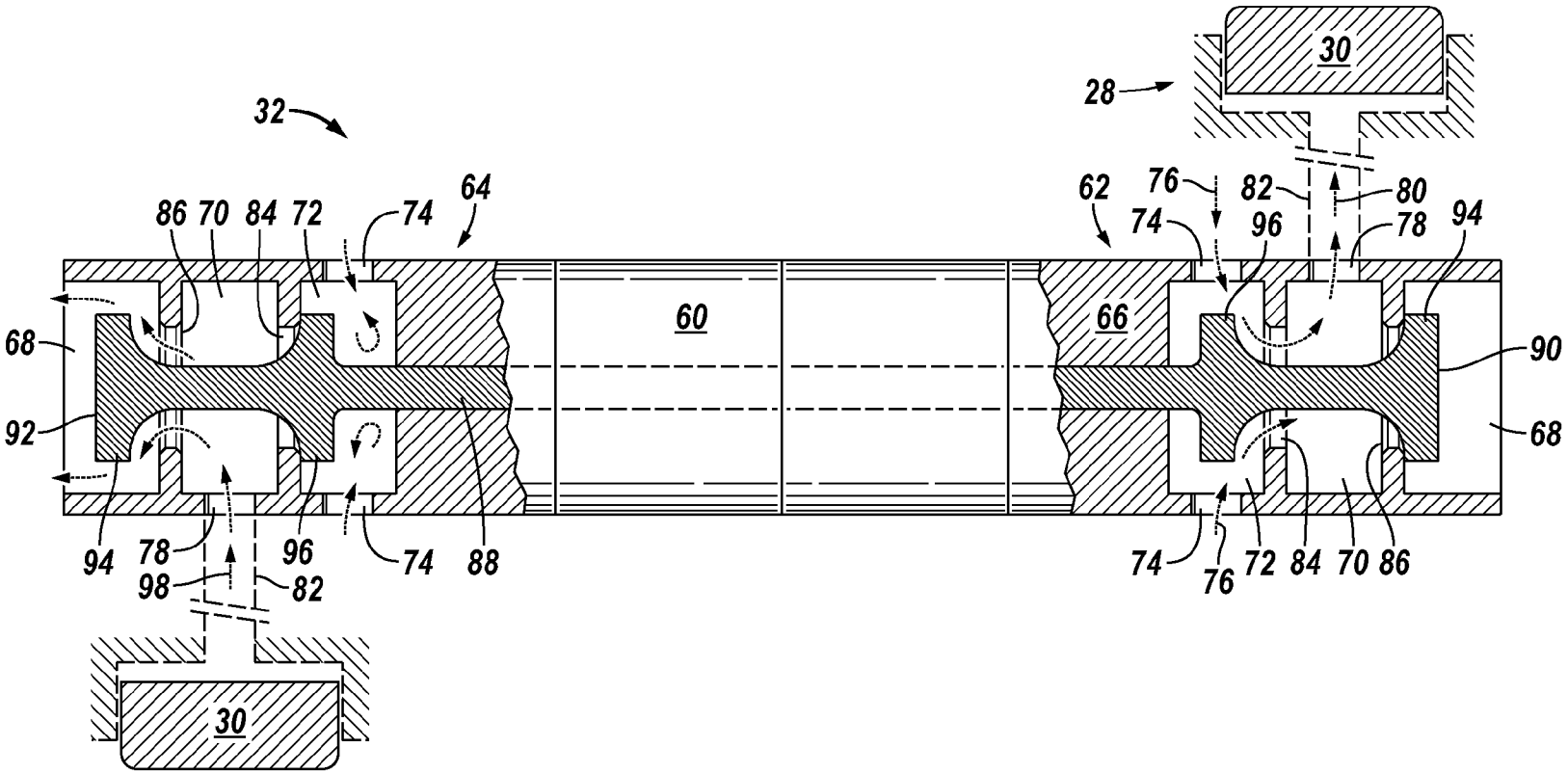
FIG. 2 is a schematic illustration of an example of a valve system configuration, according to an embodiment of the present invention.

Referring generally to FIG. 2, a schematic embodiment of valve system 32 is illustrated. In this embodiment, the valve system 32 is illustrated as coupled to a downhole tool in the form of a steerable drilling assembly 28 comprising actuating members 30, e.g. actuating pads. However, the valve system 32 may be connected to a variety of tools for which the actuation control is desired.

In the example illustrated, valve system 32 comprises an actuator 60, such as a bi-stable actuator, coupled to a first valve section 62 and a second of valve section 64. The actuator 60, first valve section 62, and second valve section 64 are contained in a single manifold 66. In this particular embodiment, manifold 66 is a symmetrical manifold which houses identical first and second valve sections 62, 64 disposed on opposite sides of the actuator 60.

Each valve section 62, 64 comprises a dumping chamber 68, a charging chamber 70, e.g. an actuating pad charging chamber, and an inlet chamber 72. The inlet chamber 72 comprises one or more openings 74, e.g. holes, through manifold 66 to enable the introduction of high-pressure actuating fluid, as represented by arrows 76. In the drilling assembly example, the high-pressure actuating fluid may comprise drilling mud or other drilling fluids 50.

Each charging chamber 70 also comprises at least one opening 78, e.g. hole, through manifold 66 to enable outflow of actuating fluid to the tool 28 to be actuated, as represented by arrow 80. In the drilling assembly embodiment, the outgoing fluid 80 flows through a corresponding passage 82 in drilling assembly 28 to move actuating members/pads 30 to an extended position.

The inlet chamber 72 and charging chamber 70 of each valve section 62, 64 are hydraulically connected via an orifice 84. Additionally, the dumping chamber 68 and charging chamber 70 of each valve section 62, 64 are hydraulically connected via an orifice 86. The orifices 84 and 86 enable flow of actuating fluid between selected chambers as controlled via a plunger 88. In some embodiments, orifices 84 and 86 may have different diameters to reduce hydraulic holding forces to a desired level. The reduction of the hydraulic holding forces can lead to decreased actuator coil force demand. In other words, the double stage valve system power requirements may be reduced due to balancing of the hydraulic holding forces acting in both directions on the actuator 60. In fact, due to the balancing of hydraulic holding forces at each end of the actuator 60, the actuator may be designed so the power consumption is nearly constant even at high differential pressures.

Plunger 88 is connected to actuator 60 and comprises plunger ends 90 and 92 which extend into first valve section 62 and second valve section 64, respectively. Each of the plunger ends 90, 92 has a first flow control tip 94 and a second flow control tip 96. The first flow control tip 94 is placed in the dumping chamber 68 and is used to control the flow of actuating fluid 50, e.g. drilling mud, from the charging chamber 70 into the dumping chamber 68 via orifice 86. The second flow control tip 96 is located in the inlet chamber 72 and is used to control the flow of actuating fluid from the inlet chamber 72 to the charging chamber 70 via orifice 84. The flow control tips 94, 96 may have a variety of geometrical shapes to provide desired flow characteristics. For example, the geometrical shapes may be selected to direct the flow of drilling mud tangentially with respect to the tips 94, 96 and the overall plunger 88 in a manner which decreases erosion and pressure losses. Additionally, the tips 94, 96 and their corresponding seats around orifices 86, 84 may be made of an erosion resistant material or a material with an erosion resistant coating depending on the types of fluids passing through the orifices.

During operation, valve system 32 functions to move plunger 88 between a plurality, e.g. two, stable positions. Because both valve sections 62, 64 are controlled by the single plunger 88, when the valve section on one side of actuator 60 opens the valve section on the other side of actuator 60 closes. In FIG. 2, for example, first valve section 62 is illustrated in an open configuration and second valve section 64 is in a closed configuration. The plunger 88 is held so the flow control tip 96 of first valve section 62 is pulled away from orifice 84. Under these conditions, pressurized actuating fluid, e.g. drilling mud, enters the inlet chamber 72 of the first valve section 62 through opening 74, as indicated by arrow 76. The high-pressure actuating fluid flows through inlet chamber 72, through orifice 84, through charging chamber 70, and out through opening 78. The actuating fluid continues to flow through passage 82 to actuating member 30 and forces the actuating member 30, e.g. actuating pad, to an extended position. While first valve section 62 is in this open position, the actuating fluid cannot flow to the annulus pressure (AP) region through its dumping chamber 68 because orifice 86 is blocked by flow control tip 94.

While the first valve section 62 is in the open position, second valve section 64 is in a closed configuration as further illustrated in FIG. 2. The second valve section 64 is closed because the flow control tip 96 of second valve section 64 blocks flow through orifice 84, thus blocking the high-pressure actuating fluid, e.g. drilling fluid, in inlet chamber 72. When in the closed configuration, plunger 88 is held at a position which locates flow control tip 94 away from orifice 86. This allows the actuating fluid, e.g. drilling mud, returning from the actuating member 30 through passage 82 to flow freely into charging chamber 70, as represented by arrow 98. The backflow or return flow passes through charging chamber 70, through orifice 86, and into dumping chamber 68 of second valve section 64 for discharge into the annulus pressure (AP) region.

Actuator 60 is selectively controllable to move each of the valve sections 62, 64 between open and closed positions. For example, moving the plunger 88 from left to right in FIG. 2 closes first valve section 62 and opens second valve section 64. In this latter configuration, the flows of actuating fluid through first valve section 62 and second valve section 64 are opposite to those described in the preceding paragraphs. Accordingly, actuator 60 may be constructed as a bi-stable actuator able to move plunger 88 back and forth, thereby selectively opening first valve section 62 while closing second valve section 64 or opening second valve section 64 while closing first valve section 62. Consequently, the flow of actuating fluid to and from the downhole tool, e.g. to and from actuating members 30, can be simply and precisely controlled.

The design of valve system 32 enables easy exhausting or discharging of actuating fluid from the actuating members so that steering capacity is not affected by backflow issues. Additionally, no internal differential pressures exist with respect to the actuator 60 because the inlet chambers 72 are always under high pressure. Additionally, hydraulic holding forces are significantly lowered due to the compensating forces acting on flow control tips 94, 96 in opposite directions. This allows the power requirements for switching the actuator 60 between stable positions to be substantially lowered. Also, because hydraulic holding forces do not depend on orifice diameters but only on the difference between them, the effective diameters of the orifices can be much higher (compared with conventional one stage valves) without affecting the actuator coil power demand when using electromagnetic actuators. As a result, pressure losses through the valve system can be reduced and the steering efficiency of drilling assemblies operating at higher RPMs is increased.

Figure 3:
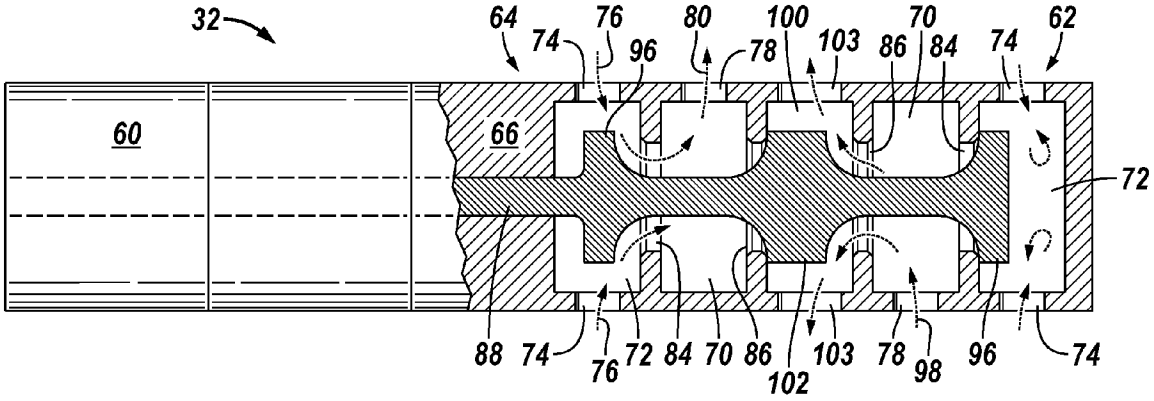
FIG. 3 is a schematic illustration of another example of a valve system configuration, according to an embodiment of the present invention.

Referring generally to FIG. 3, another embodiment of valve system 32 is illustrated. In this embodiment, the first valve section 62 and the second valve section 64 both are located on one side of actuator 60. As illustrated, the dumping chambers of valve sections 62, 64 are combined into a single, shared dumping chamber 100, and the flow control tips positioned in the dumping chambers are combined into a single flow control tip 102 positioned in the single dumping chamber 100. The flow control tips 96 illustrated in FIG. 3 remain in the inlet chambers 72 as in the embodiment illustrated in FIG. 2. In this embodiment, the flow control tips 96, 102 and their corresponding seats around orifices 84, 86 may again be made of an erosion resistant material or a material with an erosion resistant coating depending on the types of fluids passing through the orifices.

During operation, valve system 32 again functions to move plunger 88 between a plurality, e.g. two, stable positions. Because both valve sections 62, 64 are controlled by the single plunger 88, when one of the valve sections is open the other valve section is closed. In FIG. 3, for example, first valve section 62 is illustrated in a closed position and second valve section 64 is in an open position. The plunger 88 is held so the flow control tip 96 of second valve section 64 is pulled away from orifice 84. Under these conditions, pressurized actuating fluid, e.g. drilling mud, enters the inlet chamber 72 of the second valve section 64 through opening 74, as indicated by arrow 76. The high-pressure actuating fluid flows through inlet chamber 72, through orifice 84, through charging chamber 70, and out through opening 78. The actuating fluid continues to flow through passage 82 to actuating member 30 and forces the actuating member 30, e.g. actuating pad, to an extended position, as illustrated and described with reference to FIG. 2. When second valve section 64 is in this open position, the actuating fluid in second valve section 64 cannot flow to the annulus pressure (AP) region through dumping chamber 100 because orifice 86 is blocked by the single flow control tip 102.

While the second valve section 64 is in the open position, first valve section 62 is in a closed configuration as further illustrated in FIG. 3. The first valve section 62 is closed because the flow control tip 96 of first valve section 62 blocks flow through its orifice 84, thus blocking the high-pressure actuating fluid in inlet chamber 72 of first valve section 62. When first valve section 62 is in the closed configuration, plunger 88 is held at a position which locates the single flow control tip 102 away from orifice 86 of first valve section 62. This allows the actuating fluid, e.g. drilling mud, returning from the actuating member 30 through passage 82 to flow freely into charging chamber 70, as represented by arrow 98. The backflow or return flow passes through the first valve section charging chamber 70, through orifice 86, and into combined dumping chamber 100 for discharge into the annulus pressure (AP) region through an opening 103 of manifold 66.

Figure 4:
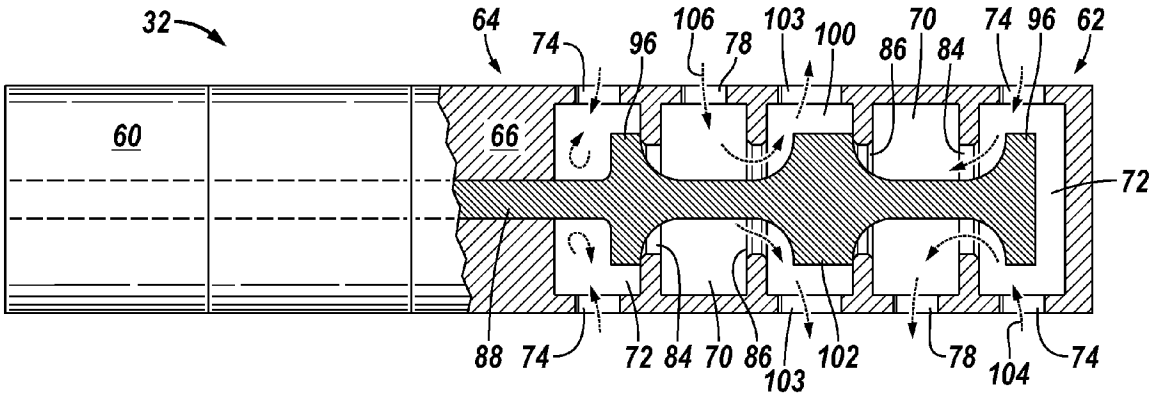
FIG. 4 is a schematic illustration similar to that of FIG. 3 but showing the valve system in a different stage of operation, according to an embodiment of the present invention.

In FIG. 4, the same embodiment of valve system 32 is illustrated as described above with reference to FIG. 3. However, FIG. 4 shows the plunger 88 shifted from left to right to a second stable position via actuator 60. When in the configuration illustrated in FIG. 4, second valve section 64 is illustrated in a closed position and first valve section 62 is in an open position. The plunger 88 is held so the flow control tip 96 of first valve section 62 is pulled away from the corresponding orifice 84. Under these conditions, pressurized actuating fluid, e.g. drilling mud, enters inlet chamber 72 of the first valve section 62 through opening 74, as indicated by arrow 104. The high-pressure actuating fluid flows through inlet chamber 72, through orifice 84, through charging chamber 70, and out through opening 78. The actuating fluid continues to flow through passage 82 to actuating member 30 and forces the actuating member 30, e.g. actuating pad, to an extended position, as illustrated and described with reference to FIG. 2. When first valve section 62 is in this open position, the actuating fluid cannot flow to the annulus pressure (AP) region through dumping chamber 100 because orifice 86 is blocked by the single flow control tip 102.

While the first valve section 62 is in the open position, second valve section 64 is in a closed configuration as further illustrated in FIG. 4. The second valve section 64 is closed because the flow control tip 96 of second valve section 64 blocks flow through its orifice 84, thus blocking the high-pressure actuating fluid in inlet chamber 72 of second valve section 64. When second valve section 64 is in the closed configuration, plunger 88 is held at a position which locates the single flow control tip 102 away from orifice 86 of second valve section 64. This allows the actuating fluid, e.g. drilling mud, returning from the actuating member 30 through passage 82 to flow freely into charging chamber 70, as represented by arrow 106. The backflow or return flow passes through the second valve section charging chamber 70, through orifice 86, and into combined dumping chamber 100 for discharge into the annulus pressure (AP) region through orifice 103.

In the embodiment illustrated in FIGS. 3 and 4, the plunger 88 has three flow control tips 96, 102. Additionally, the manifold 66 is constructed with two inlet chambers 72, two charging chambers 70, and one combined dumping chamber 68. With this type of construction, the valve sections only require one seal region with respect to the actuator 60. Placement of both valve sections 62, 64 on one side of actuator 60 also can help shorten the overall length of valve system 32.

Depending on the specific drilling application and environment, the valve system 32 may be designed in various arrangements with additional and/or alternative components. For example, actuator 60 may be in the form of a bi-stable actuator which is electrically actuated by passing electric current through a coil surrounding a movable ferromagnetic component affixed to the plunger 88. In this example, the ferromagnetic component is submersed in a fluid, such as oil, which is separated from the actuating fluid. The separation of fluids may be achieved by, for example, seals or other mechanisms, such as bellows.

Figure 5:
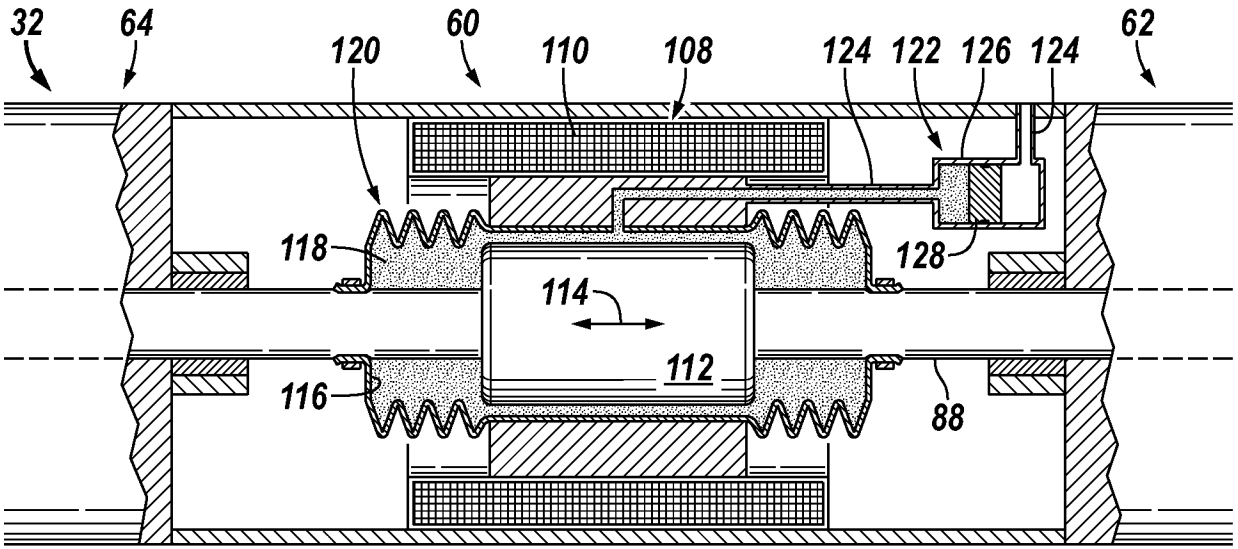
FIG. 5 is a schematic illustration of a bi-stable actuator which may be employed in the valve systems illustrated in FIGS. 1-4, according to an embodiment of the present invention.

Referring generally to FIG. 5, a schematic embodiment is provided to illustrate various features which may be incorporated into valve system 32 and its actuator 60. It should be noted the schematic illustration is designed simply to illustrate these components, and the actual configuration, size, materials, and placement of these components may vary substantially depending on the size and design of the overall valve system 32 and on the environment in which it is operated.

In the embodiment illustrated, actuator 60 is an electromagnetic actuator having a radially outer electromagnet 108 which may be formed with one or more coils 110. Within the one or more coils 110, a movable component 112, such as a movable ferromagnetic component, is mounted for axial movement in response to electrical current in coils 110, as represented by arrow 114. Depending on the polarity of the current in coils 110 and/or the arrangement of a plurality of coils, component 112 may be selectively actuated either to the left or the right between two stable positions. The bi-stable positions enable actuation of the valve sections 62, 64 between the open and closed positions, as described above.

In the embodiment illustrated, the movable component 112 of actuator 60 is enclosed in a single volume chamber 116 containing a fluid 118, e.g. a dielectric oil, separated from the actuating fluid 50. Although the chamber 116 may be segregated by a variety of devices, one example employs bellows 120 which allow axial movement of movable component 112 within coils 110 without sacrificing protection/segregation from the actuating fluid. By way of specific example, the bellows 120 may be metal bellows to provide reliability and protection against degradation in harsh, downhole environments. The metal bellows also enable elimination of a dynamic seal, thereby providing more reliable sealing in the downhole environment. Additionally, bellows 120 may be designed as spring members to bias movable component 112 toward a desired position, e.g. a stable position. The spring member bellows 120 may be employed to completely replace conventional actuator springs or to work in cooperation with actuator springs to decrease spring fatigue.

The actuator 60 also may comprise a pressure compensation system 122 to equalize internal pressure within manifold 66 and actuator 60 with the external pressure of the drilling fluid. The pressure compensation system 122 also compensates for expansion/contraction of internal fluid 118 due to temperature changes. In the embodiment illustrated, system 122 comprises one or more oil-pass channels 124 routed between the internal chamber 116 and the external environment, e.g. the drilling fluid environment. The channels 124 limit the growth of internal oil pressure within chamber 116. The pressure compensation system 122 also may comprise a compensated device 126 positioned in the flow path of channels 124 to equalize pressure without allowing commingling of internal fluid 118 with the drilling fluid. The compensated device 126 may be constructed in a variety of forms, such as a cylinder with one or more free-floating pistons 128 which separate the internal fluid and the external drilling fluid.

The various components illustrated in FIG. 5 are examples of features which can facilitate the operation of valve system 32 and thus downhole tool 28. By using a single chamber 116, for example, oil filling procedures are simplified. The internal pressure compensation channels facilitate balancing of pressures while protecting the internal fluid. The design of bi-stable actuator 60 and the balancing of hydraulic holding forces in the valve sections 62, 64 by optimizing the sizes of orifices 84, 86 enable construction of a smaller, lower power actuator to accomplish the desired control over the downhole tool. In drilling applications, the features improve control over the movable actuating pads 30 of rotary steerable drilling assemblies. In some applications, the power required by the actuator 60 can be lowered even further like cutting off the electrical power to the actuator when the plunger 88 reaches an end. This approach may be employed by monitoring a current profile to the coil 110. Initially, the current increases against time but then the current begins to drop when the plunger 88 starts moving. Once the plunger 88 has reached the other end of its travel, the current again begins to increase. When this second positive current slope appears, the electrical power to the actuator can be cut to help reduce power consumption.

The well drilling system 20 and downhole tool 28/30, e.g. steerable drilling assembly with actuating pads, may be constructed according to a variety of configurations with many types of components. The actual construction and components of the drilling system depend on the type of wellbore desired and the size and shape of the reservoir accessed by the wellbore. For example, numerous types of drill collars, sensing systems, and other components may be incorporated into the drill string. Furthermore, the valve system 32 enables a simplified design by, for example, allowing elimination of additional seals and reduction of stress in the bellows to increase the lifespan of the bellows. The lower stress is achieved, at least in part, by reducing or eliminating internal differential pressures acting on the system.

Additionally, if the controlled tool is a steering system or component of the steering system, the steering system may be part of various types of drilling assemblies, including point-the-bit assemblies and push-the-bit assemblies. The size, configuration and materials used to prepare the manifold, actuator, plunger, seals, diaphragms and other components may be different depending on the drilling application and environment.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system for facilitating a downhole operation, comprising:

a downhole tool actuated by an actuating fluid; and a valve system coupled to the downhole tool to control flow of the actuating fluid with respect to the downhole tool, the valve system comprising:

a bi-stable actuator;

a first valve section coupled to the bi-stable actuator by a plunger;

a second valve section coupled to the bi-stable actuator by the plunger, wherein movement of the plunger via the bi-stable actuator in a first direction opens flow to the downhole tool through the first valve section and closes flow to the downhole tool through the second valve section, further wherein movement of the plunger via the bi-stable actuator in a second direction closes flow to the downhole tool through the first valve section and opens flow to the downhole tool through the second valve section, wherein each of the first valve section and the second valve section has a dumping chamber, a charging chamber, and an inlet chamber through which flow is controlled by a pair of plunger tips interacting with corresponding orifices, the plunger tips and corresponding orifices being arranged to balance hydraulic holding forces.

2. The system as recited in claim 1, wherein the valve system comprises a single manifold containing the first valve section and the second valve section.

3. The system as recited in claim 1, wherein the first valve section and the second valve section are on opposite sides of the bi-stable actuator.

4. The system as recited in claim 1, wherein the first valve section and the second valve section are on the same side of the bi-stable actuator.

5. The system as recited in claim 1, wherein movement of the first valve section to an open flow position allows actuating fluid to enter the inlet chamber and to exit the charging chamber of the first valve section to actuate the downhole tool to a first configuration, further wherein movement of the first valve section to the open flow position causes the second valve section to move to a closed position which allows actuating fluid to flow back through the charging chamber and out through the dumping chamber of the second valve section.

6. The system as recited in claim 5, wherein movement of the second valve section to the open flow position allows actuating fluid to enter the inlet chamber and to exit the charging chamber of the second valve section to actuate the downhole tool to a second configuration, further wherein movement of the second valve section to the open flow position causes the first valve section to move to the closed position which allows actuating fluid to flow back through the charging chamber and out through the dumping chamber of the first valve section.

7. The system as recited in claim 1, wherein the bi-stable actuator comprises metal bellows positioned to seal off an internal chamber of the bi-stable actuator from the actuating fluid.

8. The system as recited in claim 7, wherein the metal bellows are formed as spring members to facilitate movement of the plunger.

9. The system as recited in claim 1 wherein the bi-stable actuator comprises internal oil pass channels extending between an internal chamber and a pressure compensation device.

10. The system as recited in claim 1, wherein the downhole tool comprises a plurality of actuating pads positioned to steer a drilling assembly during drilling of a wellbore.

* * * * *